US005164716A

United States Patent [19]

Taylor et al.

[11] Patent Number: 5,164,716

[45] Date of Patent: Nov. 17, 1992

[54] IMAGE PROCESSING SYSTEM

[75] Inventors: Richard J. Taylor, Barnes; Paul R. N. Kellar; Anthony D. Searby, both of Newbury, United Kingdom

[73] Assignee: Quantel Limited, Newbury, England

[21] Appl. No.: 568,531

[22] Filed: Aug. 15, 1990

Related U.S. Application Data

[63] Continuation of Ser. No. 328,728, Mar. 23, 1989, abandoned, which is a continuation of Ser. No. 207,892, Jun. 13, 1988, abandoned, which is a continuation of Ser. No. 936,990, Dec. 2, 1986, abandoned, which is a continuation of Ser. No. 594,066, Mar. 28, 1984, abandoned.

[30] Foreign Application Priority Data

Apr. 6, 1983 [GB] United Kingdom ..... 8309306

[51] Int. Cl.[5] ..... G09G 5/24

[52] U.S. Cl. ..... 340/750; 340/790

[58] Field of Search ..... 340/723, 724, 725, 727, 340/731, 735, 748, 750, 798, 799, 790, 734, 792, 726, 728, 701, 703; 358/22, 160

[56] References Cited

U.S. PATENT DOCUMENTS

| | | | |
|---|---|---|---|
| 3,896,428 | 7/1975 | Williams | 340/723 X |
| 3,976,982 | 8/1976 | Eiseler | 340/727 X |
| 4,122,444 | 10/1978 | Kitajima et al. | 340/790 X |
| 4,168,488 | 9/1979 | Evans | 340/727 X |
| 4,258,361 | 3/1981 | Hydes et al. | 340/790 X |
| 4,271,476 | 6/1981 | Lotspreda | 340/727 X |
| 4,297,694 | 10/1981 | Matherat | 340/750 |
| 4,439,761 | 3/1984 | Fleming et al. | 340/790 X |
| 4,470,042 | 9/1984 | Bornich et al. | 346/723 X |
| 4,524,421 | 6/1985 | Searby et al. | 340/703 |
| 4,529,978 | 7/1985 | Rupp | 340/727 |
| 4,533,911 | 8/1985 | Finegold | 340/735 X |
| 4,563,703 | 1/1986 | Taylor et al. | 358/160 |
| 4,566,002 | 1/1986 | Miura et al. | 340/731 X |
| 4,754,270 | 6/1988 | Murauchi | 340/731 |
| 4,6366,783 | 1/1987 | Omechi | 340/727 |

FOREIGN PATENT DOCUMENTS

| | | |
|---|---|---|
| 3026225 | 2/1982 | Fed. Rep. of Germany . |
| 2426295 | 5/1978 | France . |
| 2528208 | 6/1982 | France . |
| 2116407 | 9/1983 | United Kingdom . |
| 2119594 | 11/1983 | United Kingdom . |

OTHER PUBLICATIONS

H. J. Tafel, A. Kohl, "Input and Output apparatus of Data Technology", 1982; published by Karl Hanser Vertag, Munich and Vienna; pp. 121-124.

*Primary Examiner*—Alvin E. Oberley
*Assistant Examiner*—Richard Hjerpe
*Attorney, Agent, or Firm*—Cooper & Dunham

[57] ABSTRACT

A character generator provides video signals representing desired characters which may be held in a store capable of rapid access. The character information is processed in a manipulator to provide a change in shape, size or orientation for example. Field stores receive this manipulated information via switches as well as reference information from a generator. Read out from the respective field stores is arranged to occur when information is not being received by that store. After read out, the information is replaced by reference information, prior to the receipt of further manipulated character information. The reference information may be configured so as to include a portion of previously derived image data.

23 Claims, 3 Drawing Sheets

IMAGE PROCESSING SYSTEM

This is a continuation of application Ser. No. 328,728, filed Mar. 23, 1989, now abandoned.

BACKGROUND TO THE INVENTION

The invention relates to image processing and more specifically to systems capable of providing manipulated character generation.

In known character generation systems it is normal for the synthetically generated digital signals representing characters to be written into a frame store so as to be available for display for example. Such known system is shown in FIG. 1. The computer 10 is capable of generating signals representing many different characters. The desired character—e.g. symbol, number or letter, and its position within the image frame is selected via keyboard 11 and the momentarily generated signal data indicative of this character is received by frame store 12 for retention. In addition, a write address is also generated and the data is written into the correct group of addresses within the frame store 12 under the control of write/read control 13, typically during the line blanking period. The addresses are selected so that the order of the signals in the image raster, when they are read out for reproduction, cause them to be displayed in a desired position in the image. Data stored in the frame store 12 is cyclically read out every field period to a display monitor 14 so as to effectively produce a continuous display of the store content on monitor 14. New characters generated via keyboard 11 are written into their appropriate store addresses, by accessing the relevant designated addresses via control 13. The data already stored at other frame store addresses is retained unless new data is written over the earlier character data as when a new character is desired to be stored in the same store address.

Whilst this system works well, its use is limited as there is no provision for flexibility of operation required if the operator wished to manipulate one character relative to another for example.

OBJECT OF THE INVENTION

The present system is directed to producing system flexibility so that character manipulation is possible.

SUMMARY OF THE INVENTION

According to the invention there is provided an image processing system comprising:

input means for providing a sequence of video signals in a first configuration representing a spatial arrangement of one or more characters;

output storage means having storage locations for storing video signals;

processing means for manipulating video signals from said input means so as to write them selectively in storage locations of said output storage means to produce a configuration different from said first configuration;

reading means for reading video signals from said output storage means in said different configuration, representing a different spatial arrangement of said one or more characters;

sequencing means for said processing means and said reading means for causing manipulated video signals to be written in a first group of storage locations and to be read from a second group of storage locations during spaced time intervals, and for causing manipulated video signals to be written in said second group of storage locations and to be read from said first group of storage locations during intervening time intervals; and referencing means for restoring storage locations in said output storage means to a reference state after video signals are read therefrom and before further video signals are written therein.

In our co-pending United Kingdom Patent Application No. 8306789, UK Publication 2119594, corresponding to U.S. Pat. No. 4,563,703, there is described a system for manipulating video signals in which video signals ordered in accordance with an input image raster are re-ordered by writing the video signals in addresses in storage means which are selected to produce a change of the shape, orientation position, size or other characteristic of the image, when the signals are read from the store in a predetermined order, and subsequently reproduced. The manipulating means in systems according to the present invention are preferably systems such as described in the aforesaid patent application, the subject matter of which is incorporated herein by reference.

BRIEF DESCRIPTION OF DRAWINGS

The invention will now be described by way of example with reference to the accompanying drawings in which.

DESCRIPTION OF PREFERRED EMBODIMENTS

Figure 1:
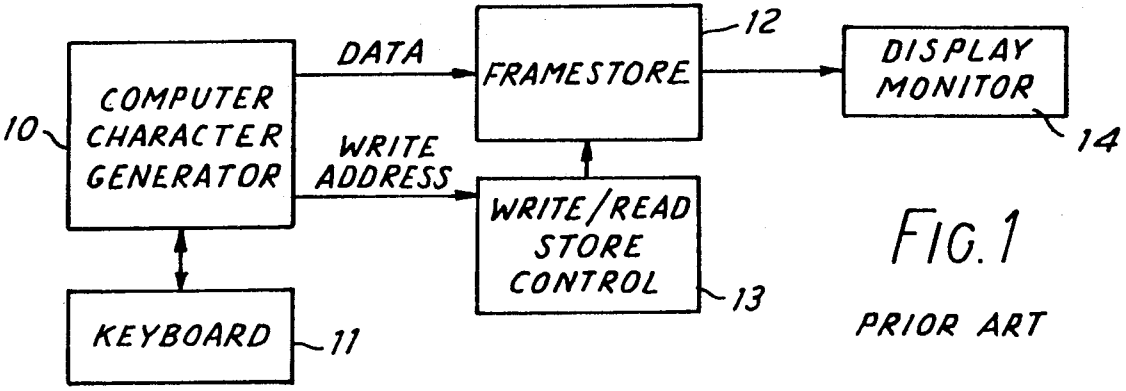
FIG. 1 PRIOR ART
FIG. 1 shows a known character generation system.
Figure 2:
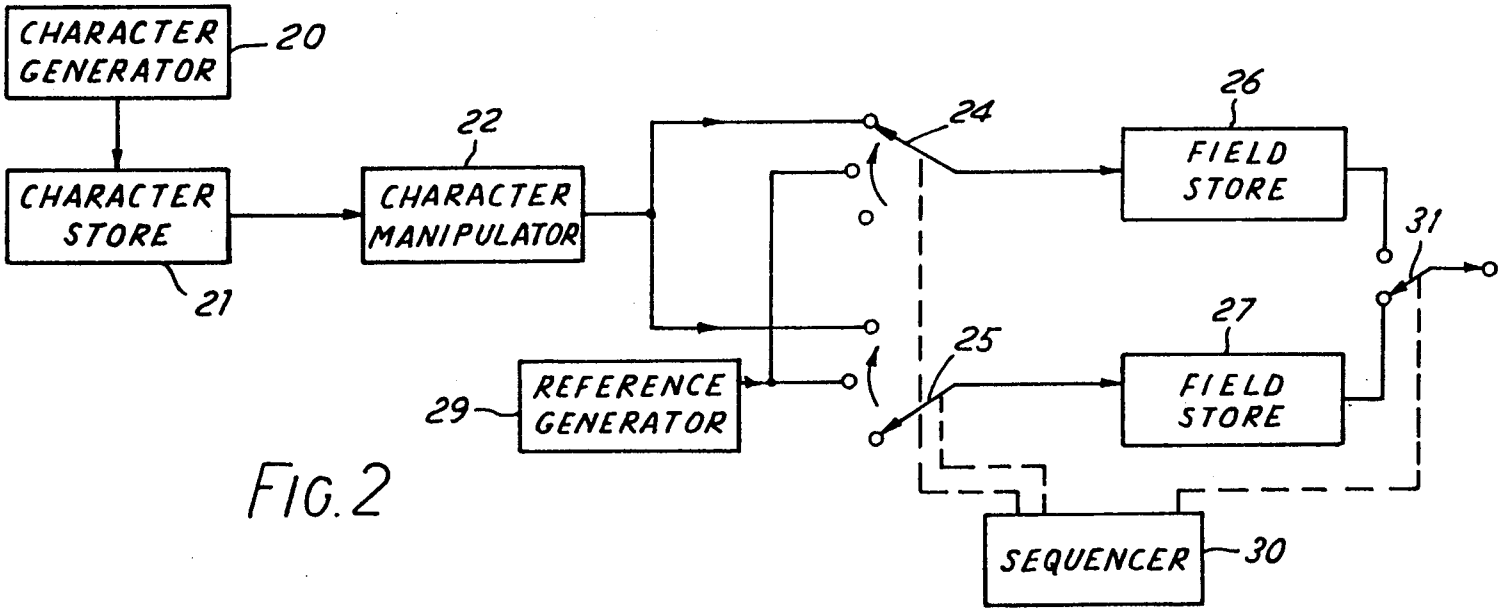
FIG. 2 shows an embodiment of the present invention.

The system of FIG. 2 shows an arrangement suitable for character manipulation.

The video signals representing desired characters are provided by a generator 20 relatively slowly and they are held in a temporary high speed character store 21. Instead of merely being displayed, they are passed to a character manipulator 22 which effects processing of the character information into a new configuration, involving, for example, a size, shape or orientation change. The manipulator in this example is a system such as described in the aforesaid copending patent application corresponding to U.S. Pat. No. 4,563,703. The video signal output from manipulator 22 passes via switches 24 or 25 selectively to the group of storage locations in field stores 26 and 27 in which they are stored in the order determined by the manipulator 22 to produce the new configuration. The stores 26 and 27 include address generators responsive to the manipulator 22, as described in the aforesaid Patent publication 2119594 corresponding to U.S. Pat. No. 4,563,703. The field store output are available for display via switch 31. The sequencing of the switches is provided by sequencer 30.

A reference generator 29 is also provided having an output available to field stores 26 and 27 via switches 4 and 25. As shown, each of the switches 24, 25 is a three position switch. In a first position the field stores receives no information via the respective switch, in the second switch position, the field stores receive reference data from the generator 29 and in the third position the field store receives character signals from the manipulator 22. It can be seen that whilst switch 25 is in the first position, the output of the relevant field store 27 is available via switch 31, so that its stored content can be read out. Read out occurs in the order appropriate to the eventual image raster, being effected by a read out circuit of known construction. After read out, switch 31 moves to the other (upper) position to receive stored data from the other field store 26, whilst switch 24 rotates clockwise to the first position where no data is received. Switch 25 moves to its second position to receive the incoming data from reference generator 29 and this data is written into all the store locations. This switch 25 then moves to the uppermost (third) position to write the manipulated characters signals from manipulator 22 into the store 27. These stored character signals are available for read out when switch 31 moves into its lower position once more. The writing of the reference signals into each field store preferably occurs during the same field period as that in which the read out of character signals occurs, but at a time when such reading is not actually occurring.

In this manner, each of the field stores is updated with newly manipulated character signals, once during each frame, the update being preceded by the restoration of all the locations in the store to a reference value using the reference data. The reference data is typically fixed (e.g. it may comprise a binary signal equivalent to peak black level) and it is written in all store positions. This allows great flexibility to be achieved as each entire field store is referenced and re-written with updated manipulated character signals. For example if the manipulation causes a reduction of the character size, the characters will appear as if moving away into the distance, which is very useful for titling effects. If desired, the signal data in one field store can be such that the respective image appears to overlap the image produced from the signals in the other field store, this effect being produced by a suitable choice of the update rate and by relying on persistence of vision of the human eye. For this effect, at least some of the 'neighbouring' addresses in the two field stores 26 and 27 will receive identical character signals.

Although the system is shown, for ease of understanding, having three position switches 24 and 25, in practice it is preferable to employ switches 24 and 25 which are capable of writing the reference data on a pixel by pixel basis, immediately following the reading of the respective signal data for a store position. Thus as the character signal on any pixel is read out from a field store, the location is immediately written into with data from the reference generator. This ensures that the reference data is written within the same field period as that in which the character signals are read out, which allows the fields to alternate.

Figure 3:
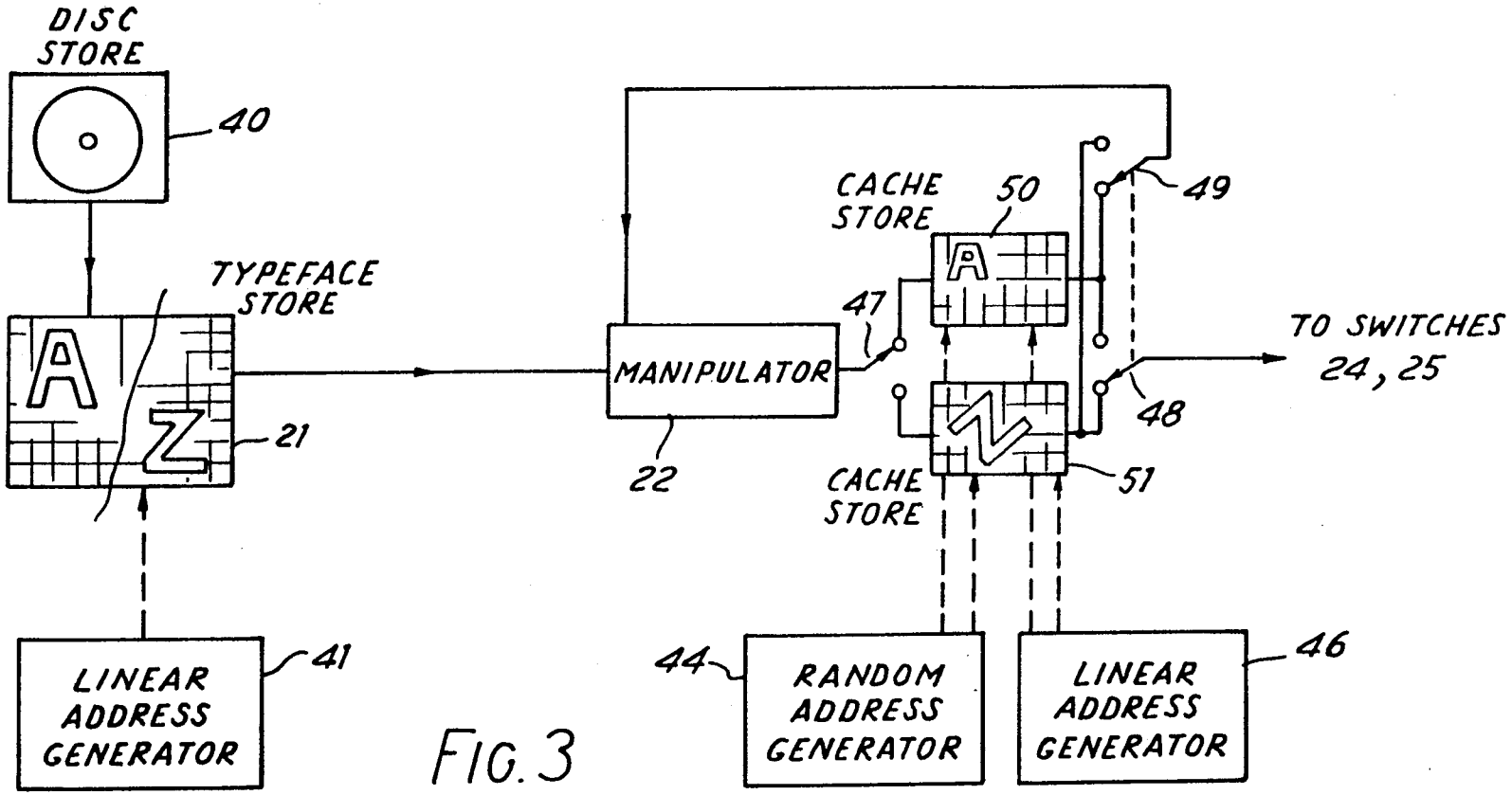
FIG. 3 shows a more detailed arrangement concerned with typeface generation.

In the FIG. 3 system an arrangement is shown which includes additional devices to allow increased processing speeds to be achieved. This arrangement is shown as dealing with typeface characters.

A library of typeface sets or fonts is stored electronically on disc 40. The operator can access one of a whole variety of sets of characters and this selected set is fed into typeface store 21 (typically 512×512 pixels). Each typeface from the set will be equivalent to several pixels high and wide and can for convenience be considered as comprising a typeface 'tile'. A whole set of such tiles can be retained in the typeface store 21.

To write the typeface data from store 40 into store 21, a linear address generator 41 is operated to read the typeface set into the appropriate addresses in the store 21, the selected tile including a character can then be read into the manipulator 22 for processing as described above with reference to FIG. 2. In the present arrangement, cache stores 50 and 51, each with the capacity to store one tile of a predetermined size are provided associated with the manipulator 22 to allow the character data relating to an individual tile to be manipulated rapidly, the data in its new configuration being written into one or other of the cache stores.

Cache stores 50 and 51 are small fast access stores (e.g., 20×20 pixels) to provide greater access speeds than the standard MOS dynamic RAM chips used to fabricate the typeface store. During or after manipulation (e.g., to produce a size change or rotation) the character data is passed to cache store 50 or 51 via switch 47 and is written into addresses selected by the manipulator as determined by a random address generator 44. Thereafter this data can be sequentially accessed in an order related to the eventual image raster as determined by a linear address generator 46 and it is passed via switch 48 for entry into field stores 26 and 27 of FIG. 2 via switches 24 or 25. Switch 49 is provided to allow signal data within cache store 50 and 51 to be available for processing together with incoming information in manipulator 22. During manipulation in 22 of data associated with cache store 50, data within cache store 51 is available for readout to the desired field store 26 or 27. The addressing circuits for stores 26 and 27, as already indicated, can be similar to generators 46 and 41. The sequencer 30 of FIG. 2 can be used to control all the various switches.

Figure 4:
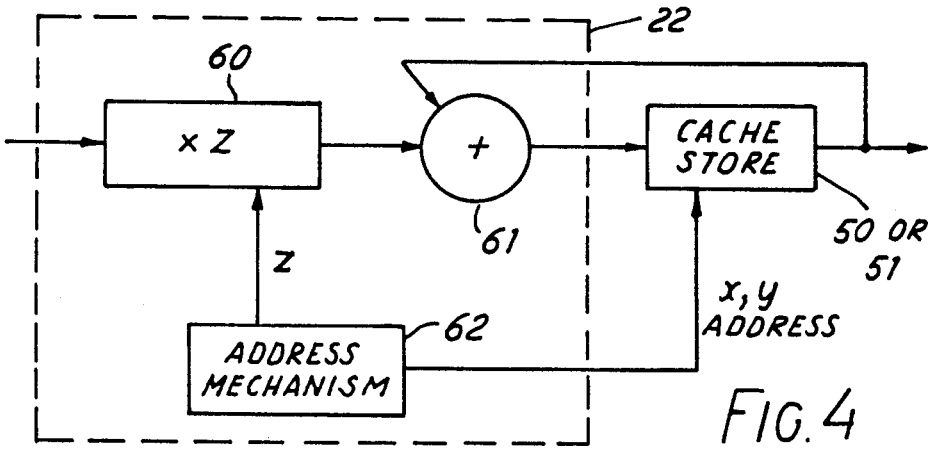
FIG. 4 shows a suitable arrangement for the manipulator therein.

The provision of the fast access cache stores, and the use of a fast manipulator such as described in our aforesaid patent application corresponding to U.S. Pat. No. 4,563,703, allows many characters to be manipulated within a single field read cycle. Part of the manipulator 22 is shown in FIG. 4. This part includes a multiplier 60, an address mechanism 62 and adder 61. As shown, manipulated data signals within cache store 50 or 51 are fed back to form a second input to adder 61. Switching between the cache stores has been omitted for ease of understanding. Character signals from typeface store 21 in FIG. 3 are received by multiplier 60 and the numerical information is multiplied by a factor less than 1 and then added to previously stored information in adder 61. The address mechanism defines the x, y address in the cache store from which the signal data is read back to the adder 61 and at which the sum from the adder is written. The z parameter used for multiplication (in this case between 0–1) is also related to the address. As indicated above, the manipulator system described in our aforesaid patent application Ser. No. 8306789 corresponding to U.S. Pat. No. 4,563,703, operates by selecting new addresses for video signals which are to be displaced in relation to the address of the video signals as originally positioned in the image raster. The new address for a video signal will not, in general, coincide with the address of any storage location in the store in which the readdressed video signals are written. It will, rather, lie within a rectangle defined by four storage locations and to achieve correct readdressing, different proportions of the video signal should be assigned to each one of said four locations, the proportions being determined by the position of the address within the rectangle. As a corollary to this, each storage location will in general receive contributions from at least four video signals. The multiplier 60, shown in FIG. 4, is arranged to produce the aforesaid proportions of the video signal before being re-written in the addresses in the cache store 50 or 51, z being the factor of proportionality which is variable from address to address. The feedback from the cache store to the adder 61 ensures that a new contribution to a storage location in the cache store is added to any contribution previously made by another video signal.

The character signals provided by the generator 20 or the store 40 may be intensity signals or full color signals, typically for R, G, B, or color difference coding (e.g., Y, I and Q for NTSC systems). If color signals are provided, the appropriate number of signals channels will be required in the system.

Figure 5:
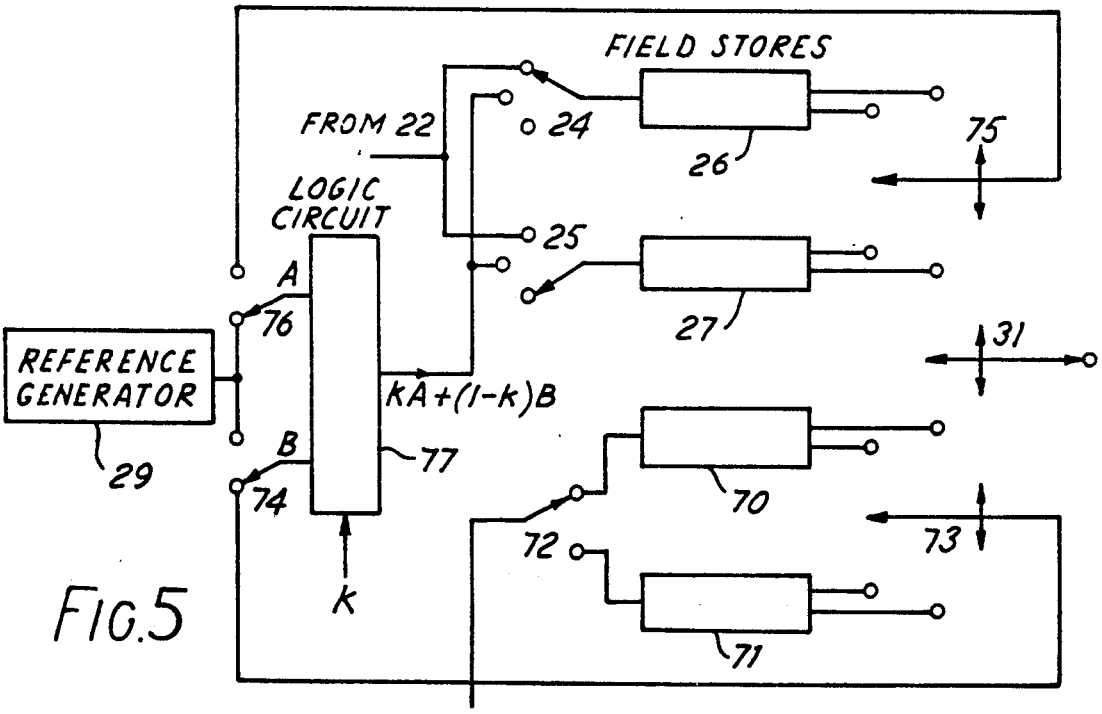
FIG. 5 shows a preferred modification of the FIG. 2 embodiment.

Referring now to FIG. 5, this illustrates a modification of the FIG. 2 embodiment and corresponding parts in the two figures are denoted by the same references. In FIG. 5, there are in addition to the field stores 26 and 27 for manipulated character signals, two further field stores 70 and 71. Input video signals can be applied alternately to these field stores during successive field periods by way of a switch 72, and such signals can be derived from a source of background signals which may be for example a video graphic device such as described in our commonly assigned U.S. Pat. No. 4,524,421, based on UK U.K. Patent Application No. 8207084 (patent publication No. 2116407 corresponding to U.S. Pat. No. 4,524,421). Alternatively fixed character signals can be used as the input signals to the switch 72. Signals can be read alternately from the stores 70 and 71 in known manner via a switch 73 and applied to one input of a switch 74. A second input of the switch 74 is connected to the output of the reference generator 29. The two field stores 26 and 27 in this example have a second output port which feeds a switch 75 and the output of this can be applied to one input of yet another switch 76, a second input of which is connected to the output of the reference generator 29. The switch 31 in the FIG. 5 arrangement can be preset so as to read output signals alternately either from the stores 26 and 27 or from the stores 70 and 71. Presetting of the switch 31 and also of the switches 74 and 76 is performed by the operator via a suitable keyboard or other control instrument.

The signals selected by the switches 74 and 76 are applied to a logic circuit 77 of a known kind. Denoting the two inputs to the circuit 77 as A and B respectively, the logic circuit is arranged to produce an output represented respectively by $KA+(1-K)B$, where K denotes a factor of between 0 and 1, which can also be selected by the operator. The output of the logic circuit 77 takes the place of the direct output of the reference generator 29 in FIG. 2 and is applied to the stores 26 and 27 via the switches 24 and 25 so as to restore the storage locations to a reference state after video signals are read therefrom by the switch 31. The switches 24, 25 and 31 are sequenced by the sequencer 30 as in FIG. 2, and the sequencer is also arranged to control the operation of the switch 72, 73 and 75.

It will be appreciated that the FIG. 5 arrangement gives greater flexibility of operation than FIG. 2, since different modes of operation can be selected by the switches 31, 74 and 76 and the factor K. In one such mode, a complex background, say a colored scene, represented by video signals applied to the stores 70 and 71 can be used to reset the field stores 26 and 27 after each read out via the switch 31. In another mode, in which the feedback from the stores 26 and 27 contributes to the signals used to reset these stores, together with the output of the generator 29, a decaying trail of characters appears in the image represented by the output signals. In yet another mode, in which fixed character signals are stored in the stores 70 and 71, fixed frozen characters appear on the output image as background, having superimposed on them the moving characters created by the signals from the manipulator 22. The mode of operation described in relation to FIG. 2 can also be obtained, and other modes of operation will be apparent. The FIG. 5 arrangement can of course also be used in an arrangement using cache stores, as illustrated in FIG. 3.

We claim:

1. A frame sequential image processing system comprising:

a) input means for providing cyclically, during a sequence of frame periods, a sequence of video signals representing a spatial arrangement of one or more characters;

b) output storage means having storage locations for storing video signals;

c) processing means for manipulating video signals from said input means during successive frame periods so as to write said video signals from said input means selectively in said output storage means in a new configuration which is updated from frame period to frame period;

d) reading means for reading successive frame of video signals from said output storage means in said new configuration, representing a new spatial arrangement of said one or more characters, for display in one or more frame periods;

e) sequencing means for said processing means and said reading means for causing manipulated video signals, representing said new spatial arrangement of characters in said new configuration, to be written in a first group of storage locations in said output storage means during first time intervals which are spaced from each other by second time intervals, wherein said first and second time intervals are shorter than said frame periods, and to be written in a second group of storage locations during said second time intervals, and to be read from said second group of storage locations during said first time intervals and from said first group of storage locations during said second time intervals; and f) means for restoring storage locations in said output storage means to a reference state upon reading video signals therefrom and before further video signals in a new configuration are written therein.

2. A system according to claim 1, in which said first and second groups of storage locations of si output storage means comprise stores for different fields of a video frame.

3. A system according to claim 1, in which said input means comprises a source of video signals each representing a different character for display.

4. A system according to claim 3, in which said source comprises a character generator for generating characters for display.

5. A system according to claim 3, in which said source comprises a library store for video signals representing a plurality of different characters for display.

6. A system according to claim 5, in which said library store has the capacity to store video signals representing the characters of a plurality of typeface fonts for display.

7. A system according to claim 1, further comprising an intermediate store for video signals representing a plurality of characters to be displayed, said intermediate store receiving signals provided by said input means and passing said signals to said processing means.

8. A system according to claim 7 in which said intermediate store has the capacity to store video signals representing a typeface font for display.

9. A system according to claim 1, including at least two small capacity cache stores which alternately receive manipulated groups of video signals from said processing means representing individual character areas, said cache stores being connected to said output storage means to pass thereto for storage therein a plurality of said groups of video signals sequentially.

10. A system according to claim 1, in which said processing means includes means for providing selected factors each of which is less than unity and for multiplying video signals received from said input means by said selected factors each of which is less than unity, and means for adding to each video signal resulting from said multiplying, before writing it at a respective storage location in the output storage means, a video signal previously stored at said storage location.

11. A system according to claim 1, in which said means for restoring selectively restores the storage locations in said output storage means to a selected one of (i) a uniform reference state and (ii) a non-uniform reference state, after video signals are read therefrom.

12. A system according to claim 11, in which said means for restoring restores said storage locations to said non-uniform reference state by applying signals representing a graphic image to storage locations in said output storage means.

13. A system according to claim 11, in which said means for restoring selectively restores said storage locations to a reference state by applying, to restore locations in said output storage means, signals including a selected proportion of signals previously stored in said storage locations.

14. A frame sequential image processing system according to claim 1, in which said means for restoring storage locations in said output storage means to a reference state comprises storing reference values in said restored locations, and said reading means comprises means for reading from said output storage means said reference values as well.

15. A frame sequential image processing system comprising:

a) input means for providing during each of a sequence of frame periods a plurality of groups of video signals respectively representing a plurality of typeface characters, said plurality of groups of video signals being provided cyclically during said sequence of frame periods;

b) output storage means having storage locations for storing a frame of video signals;

c) processing means for individually manipulating each of said groups of video signals during each frame period of said sequence of frame periods, each of said groups of video signals being manipulated during succeeding frame periods to produce, after each manipulation, a new configuration of the respective typeface characters;

d) said processing means including means for writing said manipulated groups of video signals in respective selected storage locations of said output storage means during said successive frame periods to represent a spatial arrangement of said plurality of typeface characters variable from frame period to frame period;

e) output signal means for cyclically reading video signals from said output storage means to produce successive frames of output video signals; and f) means for causing storage locations in said output storage means to store reference video values after reading video signals therefrom and before further video signals in a new configuration are written therein;

g) wherein the output signal means for reading video signals from the output storage means reads out said reference video values as well so that successive frames of output video signals comprise said groups of video signals as last manipulated, together with the respective reference video values.

16. A frame sequential image processing system according to claim 15, in which said processing means further comprises:

a) a plurality of cache stores each having the capacity to store signals representing an individual typeface character;

b) random address generator means for writing said groups of video signals provided by said input means in turn in said cache stores, one group at a time to a cache store, to produce a changed configuration determined by said random address generator means;

c) linear address generator means for reading the respective groups of video signals in changed configuration from said cache stores in turn and for writing said groups of video signals in changed configuration in said output storage means.

17. A frame sequential image processing system comprising:

a) input means for providing cyclically during a sequence of frame periods at least one group of video signals representing a character in an initial manifestation, each group of video signals defining an area small in relation to the image frame;

b) output storage means having storage locations for storing a frame of video signals;

c) processing mean for manipulating each group of video signals provided by said input means during each of a sequence of frame periods to represent a sequence of updating changes in the manifestation or position of the respective character;

d) said processing means including means for writing each group of video signals as updated during each of said frame periods in selected storage locations of said output storage means to store the respective video signals for subsequent reading;

e) output means for cyclically reading video signals form the storage locations of said output storage means to produce successive frames of output video signals;

f) reference means for causing background video values to be stored in storage locations of said output storage means not used for storing the said each group of video signals as most recently updated;

g) wherein said output means for reading video signals reads from said output storage means said background video values as well, and each frame of output video signals produced by said output means comprises said each group of video signals as updated at the respective time, together with the respective background values.

18. A frame sequential image processing system according to claim 17, in which said reference means utilizes signals read from said output storage means to produce said background video values.

19. A frame sequential image processing system according to claim 17, in which said reference means utilizes signals representing a background scene to produce said background video values.

20. A frame sequential image processing system according to claim 17, in which reference means utilizes a signal representing a uniform value to produce said background video values.

21. A frame sequential image processing system according to claim 17, in which said reference means comprises means for combining the video signals read from said output storage means with signals from another source of signals to produce said background video values.

22. A frame sequential image processing method comprising:

a) providing cyclically, during a sequence of frame periods, a sequence of video signals representing a spatial arrangement of one or more characters;

b) enabling an output storage means having storage locations for storing video signals;

c) manipulating video signals provided in said providing step during successive frame periods so as to write said video signals provided in said providing step selectively in said output storage means in a new configuration which is updated from frame period to frame period;

d) reading successive frames of video signals from said output storage means in said new configuration, representing a new spatial arrangement of said one or more characters, for display in one or more frame periods;

e) sequencing said manipulating and said reading to cause manipulated video signals, representing said new spatial arrangement of characters in said new configuration, to be written in a first group of storage locations in said output storage means during first time intervals which are spaced from each other by second time intervals, wherein said first and second time intervals are shorter than said frame periods, and to be written in a second group of storage locations during said second time intervals, and to be read from said second group of storage locations during said first time intervals and from said first group of storage locations during said second time intervals; and f) restoring storage locations in said output storage means to a reference state upon reading video signals therefrom and before further video signals in a new configuration are written therein.

23. A frame sequential image processing method as in claim 22, in which said restoring step comprises storing in the restored locations reference values and said reading step comprises reading from the storage means said reference values as well.

* * * * *